United States Patent [19]

Poehlein

[11] Patent Number: 4,821,974

[45] Date of Patent: Apr. 18, 1989

[54] ROLL MEDIA SUPPLY MOUNTING SYSTEM

[75] Inventor: Raymond E. Poehlein, Fairport, N.Y.

[73] Assignee: Xerox Corporation, Stamford, Conn.

[21] Appl. No.: 111,399

[22] Filed: Oct. 22, 1987

[51] Int. Cl.[4] ..... B65H 16/06; B65H 18/04

[52] U.S. Cl. ..... 242/68.4; 242/55.2; 242/129.51; 279/2 R

[58] Field of Search ..... 242/68.4, 55.2, 129.51, 242/129.53, 129.6, 55.54, 54 R, 128; 279/2 R

[56] References Cited

U.S. PATENT DOCUMENTS

| | | | |
|---|---|---|---|
| 3,753,570 | 8/1973 | Espasa | 242/72 X |
| 3,878,998 | 4/1975 | Lazzari | 242/55.2 |
| 4,121,783 | 10/1978 | Wolfinger et al. | 242/68.4 |
| 4,314,678 | 2/1982 | Upchurch | 242/55.2 |
| 4,452,403 | 6/1984 | Arronte | 242/68.4 X |
| 4,479,615 | 10/1984 | Nakajima et al. | 242/68.4 |
| 4,614,312 | 9/1986 | Del Pino | 242/55.2 |
| 4,668,326 | 5/1987 | Mistyurik | 242/68.4 X |

*Primary Examiner*—Stuart S. Levy
*Assistant Examiner*—Steven M. duBois

[57] ABSTRACT

A media roll supply assembly for a large document printer is disclosed which permits simplified loading and unloading of a media roll. Two end support assemblies are mounted in an axial alignment position. Each end assembly includes a spindle shaft, a hub assembly and a compressible spring. The media roll support core is seated on tapered surfaces of the hub assemblies; the compression spring allows one end to be urged outward so that, once fully seated against the hub member, one spring predominates and serves to maintain the roll in a precisely aligned axial position.

2 Claims, 6 Drawing Sheets

ROLL MEDIA SUPPLY MOUNTING SYSTEM

BACKGROUND OF THE INVENTION

This invention relates to a media roll supply assembly and, more particularly, to an improved support assembly for mounting a media roll supply and for permitting the roll to be unwound therefrom.

Printers and plotters are known in the art which are capable of producing copies of large documents such as engineering drawings, blueprints and the like. Examples of such a machine is the Xerox 2510. The image-recording media, typically paper, is supplied in roll form by winding the paper about an inner core thereby forming a roll assembly. The roll assembly must be supported in an axial position so that the paper can be unrolled in a generally flat condition and then fed into the paper path of the particular document reproduction system. The roll mounting system must be able to meet certain requirements which may vary somewhat depending upon the particular reproduction system being used. At a minimum, the roll mounting system must be able to mount media rolls which contain cores whose ends are not flush with the ends of the media and whose inner core diameter varies over some range; typically from 2.8–3.1 inches. The media roll must also be centrally positioned to center the images to be formed on the media. Most importantly, the mounting system should also permit a media roll to be easily removed and replaced.

The present invention is therefore directed to a roll media support system which incorporates two mounting end assemblies which are each adapted to provide an axially directed, compressive force to media rolls mounted thereon. The biasing forces are made unequal so that a media roll is restrained against the end assembly having the weaker force. This arrangement permits a roll to be easily replaced. More particularly, the invention is directed towards a roll supply assembly for supplying a rolled media to a machine comprising, in combination, a first and second end mount assembly, having hub members for seating ends of the roll member in an axially-aligned position, said hub member operatively connected to biasing means adapted to maintain said media roll ends in stable pressure contact with said hub members.

Additional features of the invention include a tapered surface on the hub member which enables seating of media rolls having differing diameters. Also included is an adjustment mechanism for enabling adjustment of the axial registration of the installed media roll.

DESCRIPTION OF THE INVENTION

Figure 1:
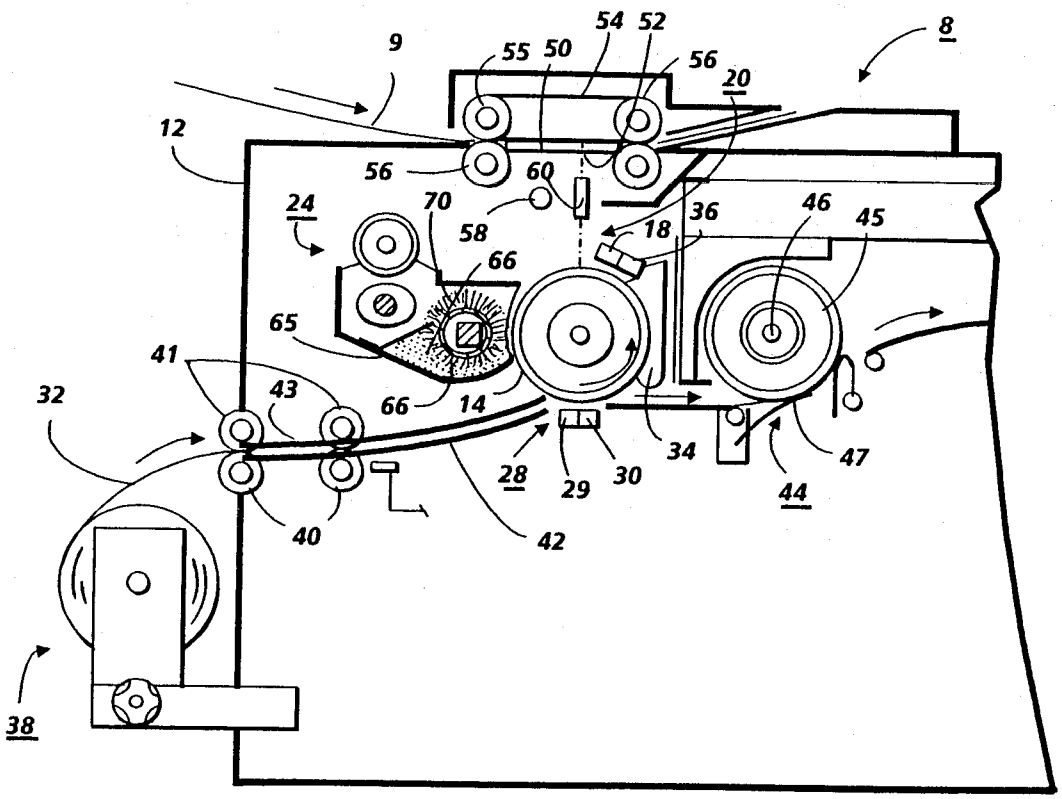
FIG. 1 is a side schematic drawing of a large document copier in which the present invention is used.

Referring to FIG. 1 of the drawings, there is shown a xerographic type reproduction machine 8 incorporating the present invention. Machine 8 has a suitable frame 12 on which the machine xerographic components are operatively supported. Briefly, and as will be familiar to those skilled in the art, the machine xerographic components include a recording member, shown here in the form of a rotatable drum 14 having a photoconductive surface. Other photoreceptors, such as a belt or web may be used instead. Operatively disposed about the periphery of drum 14 is charge corotron 18 for placing a uniform charge on the photoconductive surface of photoreceptor 14; an exposure station 20 where the previously charged photoconductive surface is exposed to image rays of the document 9 being reproduced; development station 24 where the latent electrostatic image created on the photoconductive surface is developed by toner; transfer station 28 with transfer corotrons 29, 30 for transferring the developed image to copy media 32 brought forward in timed relation with the developed image on the photoreceptor surface, and cleaning station 34 for removing leftover developer. Copy media 32, which, in a preferred embodiment is paper, is fed from media roll support assembly 38, and is brought forward by feed roller pairs 40, 41 and fed between sheet guides 42, 43. Following transfer, the media 32 is carried forward to a fusing station 44 where the toner image is fixed by fusing roll 45 in cooperation with a biased flexible web 47. Fusing roll 45 is heated by a suitable heater such as lamp 46 disposed within the interior of roll 45. After fixing, the media 32 is conveyed to a seperate output station (not shown) where the media is cut into appropriate sized image frames and, if desired, rolled into cylindrical form for easier handling.

Continuing with the description of machine 8, transparent platen 50 supports the document 9 as the document is moved past a scan point 52 by a constant velocity transport 54. As will be understood, scan point 52 is, in effect, a scan line extending across the width of platen 50 at a desired point where the document is scanned line-by-line. Transport 54 has input and output document feed roll pairs 55, 56 respectively, on each side of scan point 52 for moving a document 9 across platen 50 at a predetermined speed. Exposure lamp 58 is provided to illuminate a strip-like area of platen 50 at scan point 52. The image rays from the document line scanned are transmitted by a gradient index lens array 60 to exposure station 20 to expose the photoreceptor surface of the moving photoreceptor 14.

Developing station 24 includes a developer housing 65, the lower part of which forms a sump 66 for holding a quantity of developer. A rotatable magnetic brush developer roll 70 is disposed in predetermined operative relation to the photoconductive surface, in developer housing 65, roll 70 serves to bring developer from sump 66 into developing relation with drum 14 to develop the latent images formed on the surface thereof.

In the preferred embodiments, document 9 represents a large (36 inch) engineering drawing. The width of the photoreceptor and the dimensions of the developer, transfer, cleaning, fusing and media roll support assembly are of like dimensions.

Figure 2A:
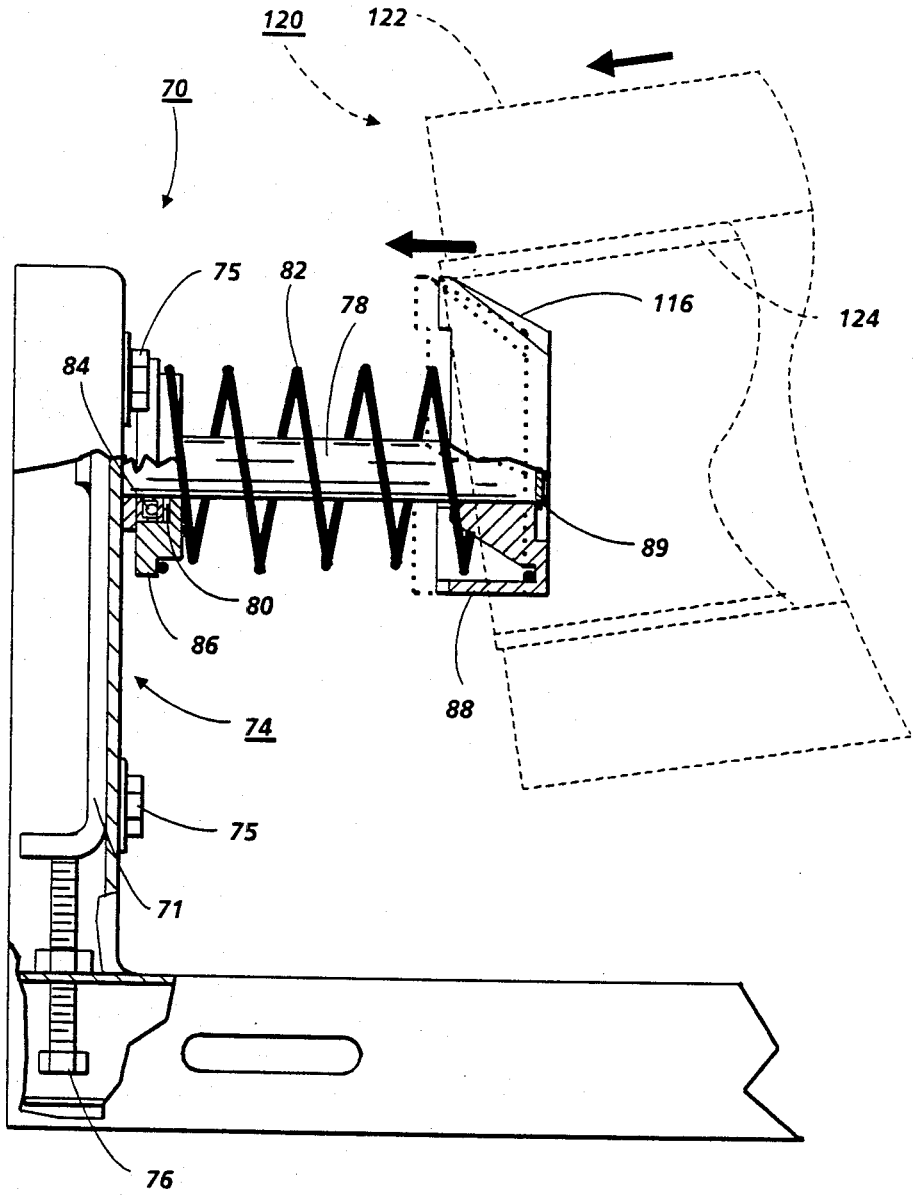
FIG. 2*a* and 2*b* are front views of the two ends of the media roll support assembly of the present invention.
Figure 2B:
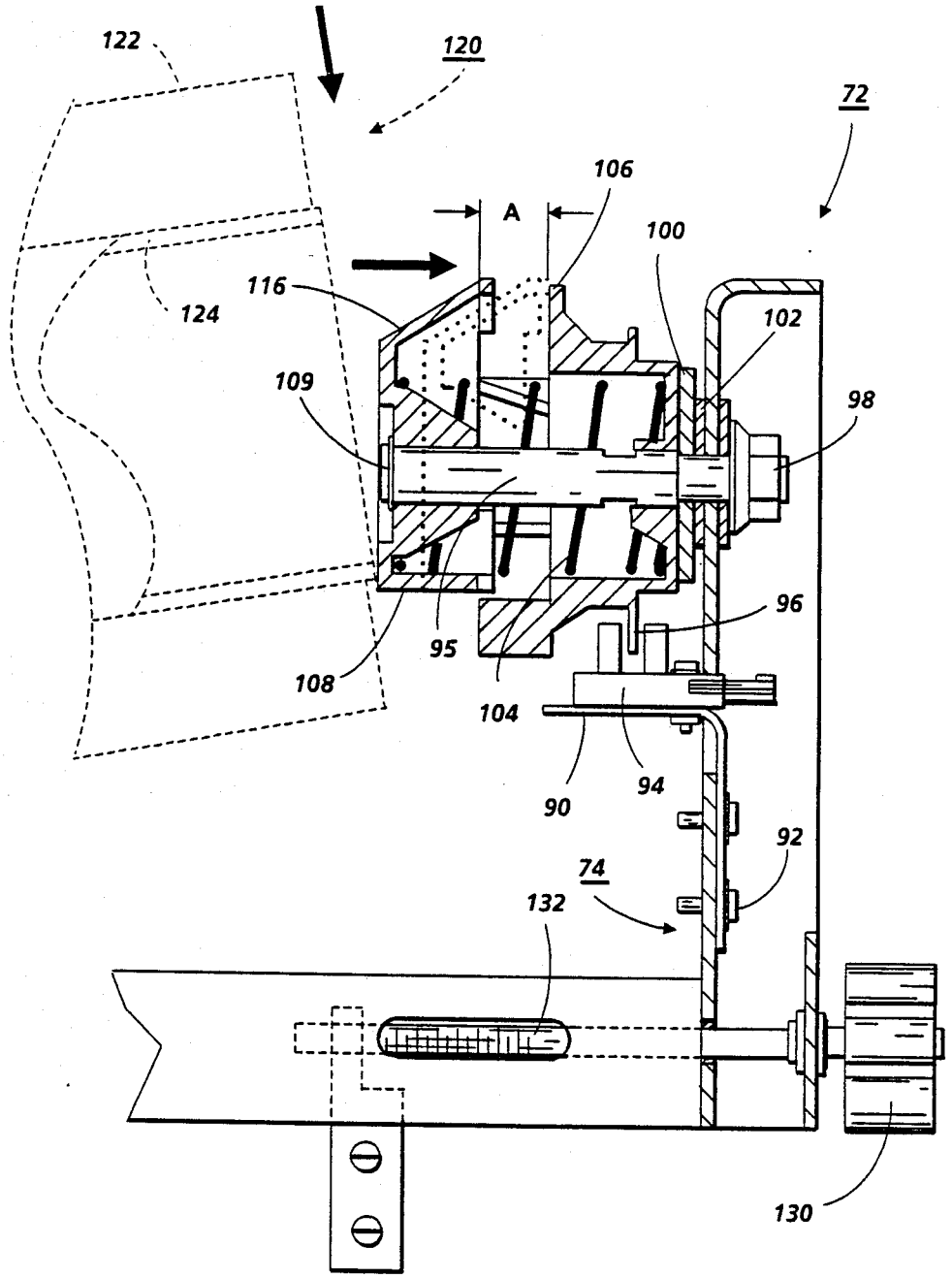
Figure 3:
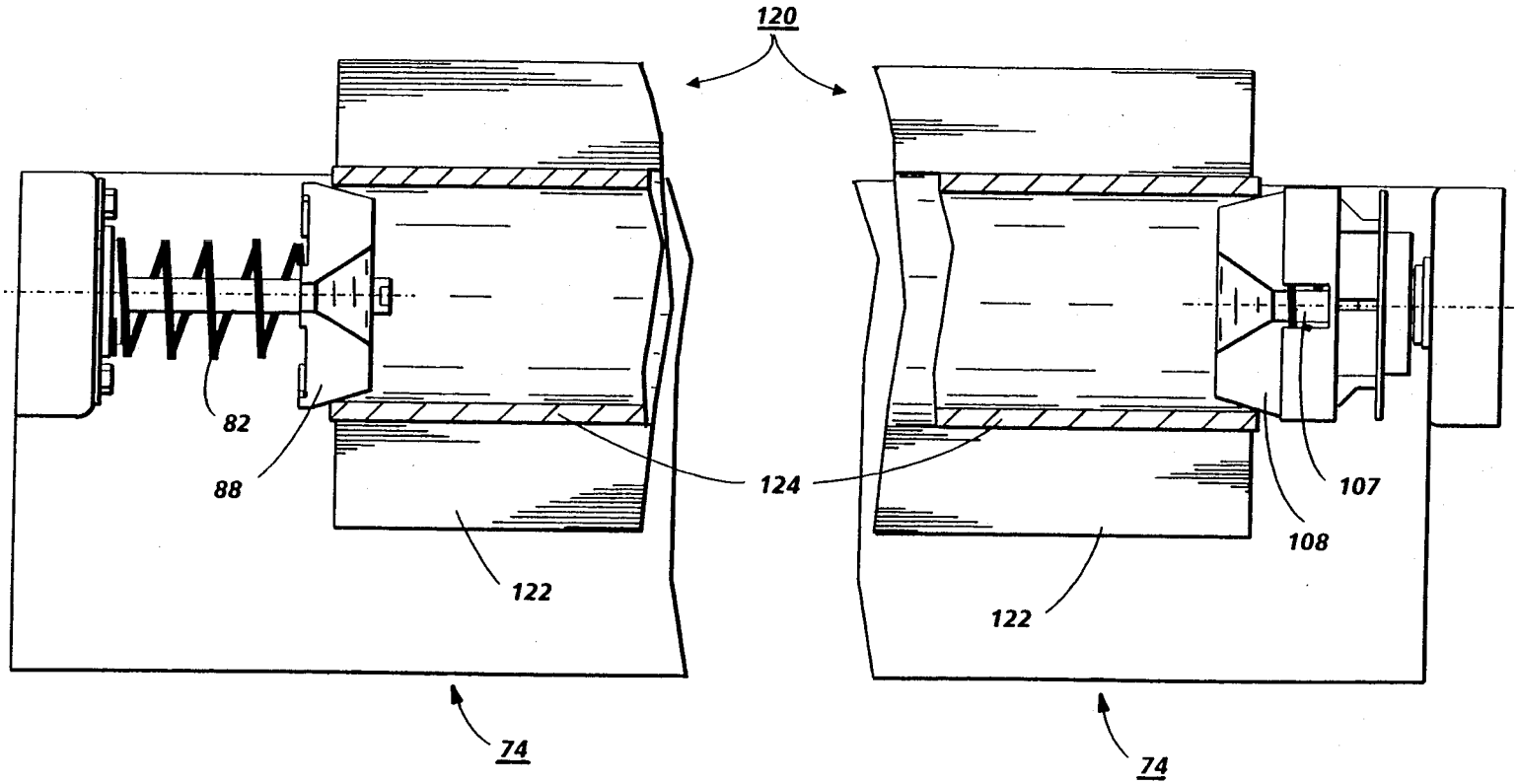
FIG. 3 is a top view of the support assembly of FIG. 2.

Turning now to the media roll support assembly 38 of the present invention, FIGS. 2*a* and 2*b* show a front view of each side of the assembly without a media roll installed; FIG. 3 shows a top view of the assembly with a media roll installed. The assembly is seen to consist of a first (left) end mount assembly 70 (FIG. 2*a*) and a second (right) end mounting assembly 72 (FIG. 2*b*).

Assembly 70 comprises a mounting bracket 71 and spindle shaft 78 which is connected to plate 74 by means of screws 75. Slots in mounting bracket 71, through which screws 75 extend, allow for vertical adjustment of adjusting screw 76. Such adjustment is necessary to ensure proper alignment of the media roll to the reproduction machine. Encircling shaft 78 is a spiral compression spring 82. Mounted on the inner end of the spindle shaft 78, and in pressure contact with spring 82 is end hub member 88. Spring 82 forces hub member 88 towards the right to engage supply roll core 124. When supply roll 122 rotates, hub member 88 and spring 82 also rotate about fixed spindle shaft 78. To provide for free rotation of spring 82, a thrust bearing 80 is installed between spring end seat 86 and plate 74. E Ring 89 prevents the hub member 88 from coming off the spindle shaft when the media supply roll is removed.

Examining next the right end mounting assembly 72, (FIG. 2*b*), the assembly comprises a right angle mounting bracket 90 connected to base plate 74 by screws 92. Mounted to mounting bracket 90 is an optical sensor 94. Optical sensor 94 interacts with an encoder wheel 96 that is an integral part of stop member 106. The optical sensor 94 and encoder wheel 96 function together to sense when the amount of media left on the supply roll is low and when it is completely depleted. When this occurs, the machine operator is alerted. Spindle shaft 95 remains stationary and is axially supported by hex nut 98 and washers, 102. Thrust washer 100 accepts the axial thrust force from stop member 106. The interaction between thrust washer 100 and stop member leads to a system drag torque that is necessary for system function.

Encircling the spindle shaft is a second spiral compression spring 104. Mounted on spindle shaft 95, and adapted to rotate therewith, is stop member 106 and end hub member 108. E Ring 109 prevents hub member 108, spring 104 and stop member 106 from coming off the spindle shaft when the media supply roll is removed. Stop member 106 has three notches 107 (shown in FIG. 3) which mesh with the triangular portions 116 of hub member 108. When fully seated, hub member 108 is interlocked with stop 106 and both members rotate on spindle shaft 95.

Figure 4:
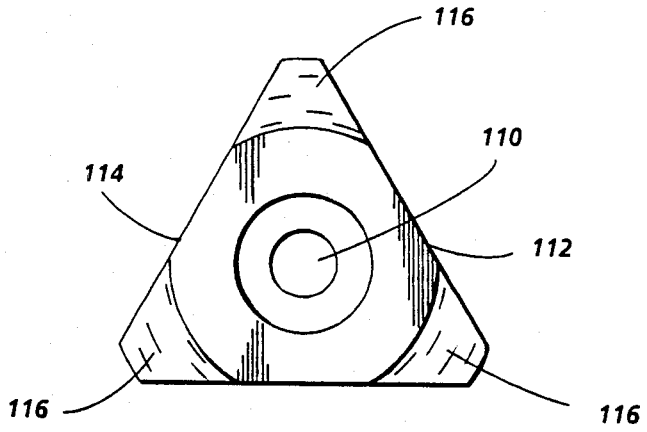
FIG. 4 is a front view of a hub assembly for seating the media roll.
Figure 5:
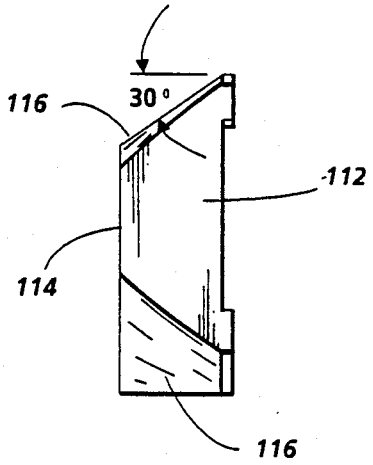
FIG. 5 is a side view of the hub assembly of FIG. 4.

FIGS. 4 and 5 show a front and side view, respectively, of hub members 88, 108. The hub is a unitary plastic piece having an aperture 110 therethrough to accomodate the spindle shafts. The member is triangular in shape with sides 112 normal to outer surface 114. Three chamfered, slightly conical surfaces 116 form approximately a 30° angle to normal as shown in FIG. 5.

Figure 6:
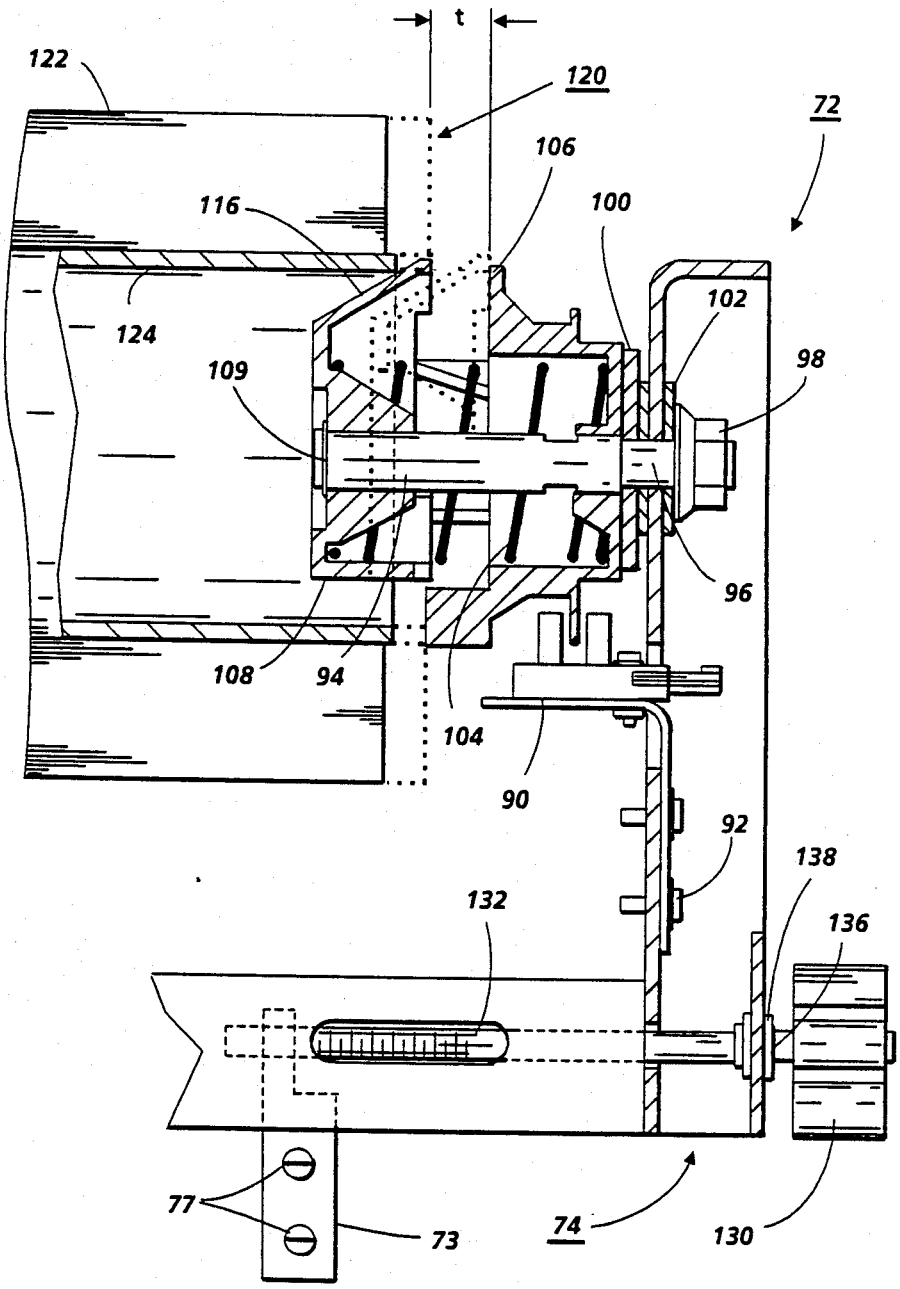
FIG. 6 is the view of support assembly of FIG. 2*b* showing a media roll after being mounted.

Having described, in general, the components comprising mounting assembly 38, their function will be described in connection with the mounting of a paper roll. Referring to FIGS. 2*a*,2*b*, a media roll 120, approximately 36 inches in length, is shown in an initial (dotted) position. Media roll 120 comprises a supply of rolled paper 122 mounted on support roll core 124. An operator aligns roll 120 at a slight upward angle so that its left end seats against surfaces 116 of hub member 88. The operator then exerts a leftward force compressing spring 82. Simultaneous with this leftward motion, the operator lowers the right end of the media roll to attain a horizontal axial alignment. As the operator slowly relaxes the left end compressive force, the right end of the roll is axially urged into seating contact with surfaces 116 of hub member 108. FIG. 6 shows the seated position of the right end of roll 120. The compressive ratio of springs 82 and 108 have been set such that the former exerts a stronger force. Thus, as the operator releases the media roll, following initial axial alignment, the roll is urged rightward under the uncoiling superior force of spring 82 compressing spring 104. As spring 104 compresses, hub member 108 moves rightward across space t purposely left between the surface of stop 106 and abutting surface of hub 108. The dotted line shows the fully seated position of the media roll. The hub member has been forced rightward until the end of support roll core 124 contacts stop member 106. This action ensures that the support roll core 124 is located properly in the axial direction. As seen in FIG. 6, support roll core 124 actually contacts the chamfered surface 116 of the end hubs so that no contact is made with the rolled paper 122. Because of the tapered nature of surface 116, media rolls of slightly different diameters can be accomodated; the core ends will simply be seated higher or lower along surface 116.

Once the media roll is installed, the roll can be rotated and unrolled as described in the system description, supra.

According to another aspect of the invention, the axial position of the installed media roll can be adjusted to compensate for center misalignments where the media roll core 124 may not be exactly flush with the supply paper 122 wrapped around it. As shown in FIG. 6, adjustment knob 130 is connected to threaded shaft 132 which, in turn, is connected to threaded bracket 73. Bracket 73 is secured to the main machine frame by two screws 77. Threaded shaft 132 is secured to base plate 74 by retaining rings 136 and thrust washers 138. Clockwise movement of the knob causes assembly 38 to advance to the left; counterclockwise movement moves the assembly to the right. Exact position is determined by visually checking the image centering on the putput copy.

While the invention has been described with reference to the structure disclosed, it is not confined to the details set forth, but is intended to cover such modifications or changes as may come within the scope of the following claims:

What is claimed is:

1. A roll media supply mounting system comprising, in combination, a first end mount assembly including a rotatable spindle shaft about which is mounted a first compression spring, and a first hub assembly mounted on the inner end of said spindle shaft; a second end mount assembly including a second spindle shaft axially aligned with said first spindle shaft, said second mount assembly further including a second compression spring, having a compressive force unequal to the compressive force of said first compression spring, encircling said second spindle shaft and a second hub member mounted on the inner end of said second spindle shaft in opposed, axial alignment with said first hub member, said first and second hub members being adapted to resiliently accomodate an installation of a media roll and subsequently to maintain the media roll in a fixed axial position due to the unequal compressive forces of the two compression springs.

2. The mounting system of claim 1 wherein said hub members have a plurality of chamfered surfaces in opposed relation to each other whereby the media roll, when installed, abuts directly against these chamfered surfaces.

* * * * *